US006026272A

United States Patent [19]

Kusaka et al.

[11] Patent Number: 6,026,272

[45] Date of Patent: Feb. 15, 2000

[54] IMAGE FORMING APPARATUS HAVING FIXING APPARATUS WITH CLEANING DEVICE

[75] Inventors: Kensaku Kusaka, Ibaraki-ken; Akiyoshi Kimura, Kawasaki; Minoru Nada, Kashiwa; Hirokazu Takahashi, Matsudo; Ryuichi Iwanaga, Tokyo; Kazuhiko Ishiwata, Kashiwa; Hidekazu Maruta, Yokohama; Shinichi Konno, Matsudo; Shigeaki Takada, Tokyo, all of Japan

[73] Assignee: Canon Kabushiki Kaisha, Tokyo, Japan

[21] Appl. No.: 09/027,246

[22] Filed: Feb. 20, 1998

[30] Foreign Application Priority Data

Feb. 21, 1997 [JP] Japan ..... 9-054115

[51] Int. Cl.[7] ..... G03G 15/20

[52] U.S. Cl. ..... 399/327; 219/216

[58] Field of Search ..... 399/327, 329, 399/331, 334, 67, 71; 219/216

[56] References Cited

U.S. PATENT DOCUMENTS

| | | | |
|---|---|---|---|
| 3,706,491 | 12/1972 | Furman et al. | 355/133 |
| 3,861,860 | 1/1975 | Thettu et al. | 432/59 |
| 3,883,292 | 5/1975 | Hamaker | 432/60 |
| 3,921,573 | 11/1975 | Thettu | 118/70 |
| 4,518,976 | 5/1985 | Tarumi et al. | 347/155 |
| 4,607,947 | 8/1986 | Ensing et al. | 399/308 |
| 4,777,498 | 10/1988 | Kasamura et al. . | |
| 4,799,084 | 1/1989 | Koike et al. . | |
| 4,954,845 | 9/1990 | Yano et al. . | |
| 5,008,713 | 4/1991 | Ozawa et al. . | |
| 5,026,276 | 6/1991 | Hirabayashi et al. . | |
| 5,043,763 | 8/1991 | Koh et al. . | |
| 5,051,784 | 9/1991 | Yamamoto et al. . | |
| 5,083,168 | 1/1992 | Kusaka et al. . | |
| 5,085,423 | 2/1992 | Nishimoto et al. . | |
| 5,115,278 | 5/1992 | Maruta et al. . | |
| 5,132,744 | 7/1992 | Maruta et al. . | |
| 5,149,941 | 9/1992 | Hirabayashi et al. . | |
| 5,162,634 | 11/1992 | Kusaka et al. . | |
| 5,171,145 | 12/1992 | Kusaka et al. . | |
| 5,182,606 | 1/1993 | Yamamoto et al. . | |
| 5,235,395 | 8/1993 | Ishiwata . | |
| 5,241,155 | 8/1993 | Koh et al. . | |
| 5,262,834 | 11/1993 | Kusaka et al. . | |
| 5,266,774 | 11/1993 | Kimura et al. . | |
| 5,267,005 | 11/1993 | Yamamoto et al. . | |
| 5,280,308 | 1/1994 | Takahashi et al. . | |
| 5,309,210 | 5/1994 | Yamamoto et al. . | |
| 5,343,280 | 8/1994 | Hirabayashi et al. . | |
| 5,401,936 | 3/1995 | Kusaka et al. . | |
| 5,464,291 | 11/1995 | Kimura et al. . | |
| 5,475,194 | 12/1995 | Watanabe et al. . | |
| 5,512,729 | 4/1996 | Kusaka et al. | 219/216 |
| 5,592,277 | 1/1997 | Kusaka et al. . | |
| 5,592,280 | 1/1997 | Ishizuka et al. . | |
| 5,660,750 | 8/1997 | Kusaka . | |
| 5,674,016 | 10/1997 | Kimura et al. . | |
| 5,724,637 | 3/1998 | Senba et al. . | |

FOREIGN PATENT DOCUMENTS

| | | |
|---|---|---|
| 57-004081 | 1/1982 | Japan . |
| 61-067071 | 4/1986 | Japan . |
| 04-180080 | 6/1992 | Japan . |
| 5-241478 | 9/1993 | Japan . |
| 6-175520 | 6/1994 | Japan . |

*Primary Examiner*—Robert Beatty
*Attorney, Agent, or Firm*—Fitzpatrick, Cella, Harper & Scinto

[57] ABSTRACT

An image forming apparatus comprising an image forming unit for forming a non-fixed toner image on a recording material, a heater for heating the non-fixed toner image, a back-up member for cooperating with the heater to form a nip therebetween, the back-up member pinching and conveying the recording material at the nip in such a manner that the non-fixed toner image is contacted with the heater so that the non-fixed toner image is fixed to the recording material by heat from the heater, and a cleaning member for cleaning the back-up member. The cleaning member is brought into a first and second cleaning mode in which an image forming operation is not effected and the back-up member is cleaned, the second cleaning mode having a cleaning time longer than a cleaning time of the first cleaning mode.

25 Claims, 7 Drawing Sheets

IMAGE FORMING APPARATUS HAVING FIXING APPARATUS WITH CLEANING DEVICE

BACKGROUND OF THE INVENTION

1. Field of the Invention

The present invention relates to an image forming apparatus such as a copying apparatus, a laser beam printer and the like for forming a toner image corresponding to an original image or inputted image signal on a recording material in a transferring manner or a direct manner, and more particularly, it relates to a fixing apparatus for fixing a non-fixed toner image formed on a recording material used in such an image forming apparatus to the recording material.

2. Related Background Art

For example, in image forming apparatuses such as copying machines and printers utilizing transfer-electrophotographic process, a photosensitive member (image bearing member) uniformly charged by a charger is image-exposed by illuminating light corresponding to an original image or an image signal inputted from a computer to thereby form an electrostatic latent image on a surface of the photosensitive, and then, the electrostatic latent image is developed by a developing means as a toner image, and the toner image is transferred onto a transfer material (recording material) by a transfer means, and the toner image on the transfer material is fixed to the transfer material by a fixing means to obtain an imaged product (copy, print).

As one of fixing devices for fixing the non-fixed toner image formed on the transfer material to the transfer material as a permanent fixed image, there is a fixing device of on-demand film fixing type.

In this fixing device of on-demand film fixing type, a heat-resisting fixing film is slidingly contacted with a heating member and a pressurizing member is urged against the heating member with the interposition of the fixing film to form a nip so that the non-toner image is thermally fixed to the transfer material by thermal energy from the heating member via the fixing film while the transfer material (bearing the non-fixed toner image thereon) is being introduced between the fixing film and the pressurizing member at the nip and is being conveyed together with the fixing film.

An example of such a fixing device of film fixing type is shown in FIG. 7. A ceramic heater (heating member) 120 is secured to and supported by a lower part of a heat-resisting and heat-insulating stay (heater supporting member) 21 having rigidity. An endless fixing film 25 formed by coating material having good mold releasing property on high heat-resisting material and mounted on a drive roller 26 and a driven roller 27 (which are disposed substantially in parallel with the heater 120) is slidingly contacted with the heater 120.

A pressure roller (rotatable pressurizing member) 128 is urged against a lower surface of the heater 120 with the interposition of the fixing film 25. The pressure roller 128 has an elastic rubber (for example, silicone rubber) layer having good mold releasing property and cooperates with the heater 120 to form a fixing nip N therebetween.

When the drive roller 26 is rotated by a drive motor (rotation driving means) M in a direction shown by the arrow, the fixing film subjected to predetermined tension from the driven roller 27 (also acting as a tension roller) is rotated at a predetermined peripheral speed in a direction shown by the arrow a, and the pressure roller 128 is rotatingly driven in an anti-clockwise direction by movement of the fixing film 25.

In a condition that the fixing film 25 is rotatingly driven and the heater 120 is heated and heat-adjusted to a predetermined temperature, a transfer material P (on which a non-fixed toner image T was formed) outputted from an image forming means (not shown) is introduced between the fixing film 25 and the pressure roller 128 at the fixing nip N with the imaged surface facing the fixing film 25, so that the transfer material P is conveyed through the fixing nip N together with the fixing film 25 with the imaged surface of the transfer material closely contacted with the outer surface of the fixing film 25; meanwhile, the non-fixed toner image T is thermally fixed to the surface of the transfer material P by thermal energy from the heater 120 via the fixing film 25.

In such a fixing device of film fixing type, electric power can be saved and a waiting time can be shortened (i.e., quick starting ability can be achieved) on demand, since heat capacities of the heater (heating member) 120 and the fixing film 25 for transmitting the thermal energy from the heater 120 to the transfer material P can be reduced.

However, the fixing device of film fixing type has the following disadvantages.

That is to say, when the non-fixed toner image T on the transfer material P is being passed through the fixing nip N, a small amount of toner is transferred from the transfer material P to the outer surface of the fixing film 25 (offset phenomenon).

A part of the toner offset to the outer surface of the fixing film 25 is transferred onto the same transfer material P again after the fixing film 25 is rotated by one revolution or is remaining on the fixing film 25 and then transferred onto a next transfer material P.

Since the amount of toner transferred to the transfer material is very small, there is no practical problem.

However, a part of the toner offset to the outer surface of the fixing film 25 is also transferred onto the surface of the pressure roller 128. When the toner is once adhered to the pressure roller 128, the mold releasing ability of the portion of the pressure roller 128 to which the toner is adhered is considerably worsened, so that the toner is apt to be adhered to such a portion. Consequently, a land-shaped thin toner layer is formed on the surface of the pressure roller 128.

An adhering force of the thin toner layer to the pressure roller 128 is weak when a surface temperature of the pressure roller 128 is low (particularly, when the surface temperature is lower than a glass transition temperature).

In the fixing apparatus of this kind, when the apparatus is in a waiting condition, the heater (heating member) 120 is not energized. That is to say, the heater 120 is not heated. Accordingly, the temperature of the pressure roller 128 is normally maintained to substantially a room temperature (i.e., below the glass transition temperature).

In such a condition, when the fixing operation is started, the temperature of the surface of the fixing film 25 is quickly increased at the fixing nip N. Before the transfer material P reaches the fixing nip N, the surface of the thin toner layer adhered to the surface of the pressure roller 128 is softened and is closely contacted with the fixing film 25. As a result, a part of the thin toner layer on the pressure roller 128 is separated from the pressure roller 128 and is transferred onto the fixing film 25. The toner transferred to the fixing film 25 then reaches the fixing nip N, where the toner is successively transferred to the transfer material being passed through the fixing nip. As a result, the surface of the transfer material is contaminated in spots.

In order to prevent the spotted contamination on the transfer material P due to the toner contamination of the pressure roller 128, as shown by the two-dot and chain line in FIG. 7, there has been proposed a technique in which a roller 133 formed from metal such as aluminum having good heat conductivity and high surface energy is contacted with the pressure roller 128 and is rotatingly driven by rotation of the pressure roller 128 so that the toner is transferred from the pressure roller 128 to the roller 133 to collect the toner.

However, in the normal use, the toner (on the pressure roller 128) contacted with the roller 133 is not thermally deformed, since a surface temperature of the roller 133 is not increased up to the glass transition temperature of the toner to thereby worsen the collecting ability of the toner from the pressure roller 128 to the roller 133.

Further, although the roller 133 is rotatingly driven by the rotation of the pressure roller 128, the roller 133 is also rotated only during the fixing operation, since the pressure roller 128 is normally rotated only during the fixing operation, so that the cleaning of the pressure roller 128 becomes insufficient.

SUMMARY OF THE INVENTION

An object of the present invention is to provide a fixing apparatus and an image forming apparatus, which can prevent contamination of a recording material caused by contamination of a back-up member.

Another object of the present invention is to provide an image forming apparatus which has first and second cleaning modes in which an image forming operation is not effected and a back-up member is cleaned by a cleaning member and a second cleaning mode has a cleaning time longer than that of the first cleaning mode.

A further object of the present invention is to provide a fixing apparatus in which a temperature of a cleaning member for cleaning a back-up member cooperating with a heater to form a nip therebetween with the interposition of a film is maintained above a glass transition temperature of toner and below a softening temperature of the toner during at least a part of a cleaning operation.

The other objects and features of the present invention will be apparent from the following detailed explanation referring to the accompanying drawings.

DETAILED DESCRIPTION OF THE PREFERRED EMBODIMENTS

The present invention will now be fully explained in connection with embodiments thereof with reference to the accompanying drawings.

<First Embodiment (Embodiment 1)>

Figure 1:
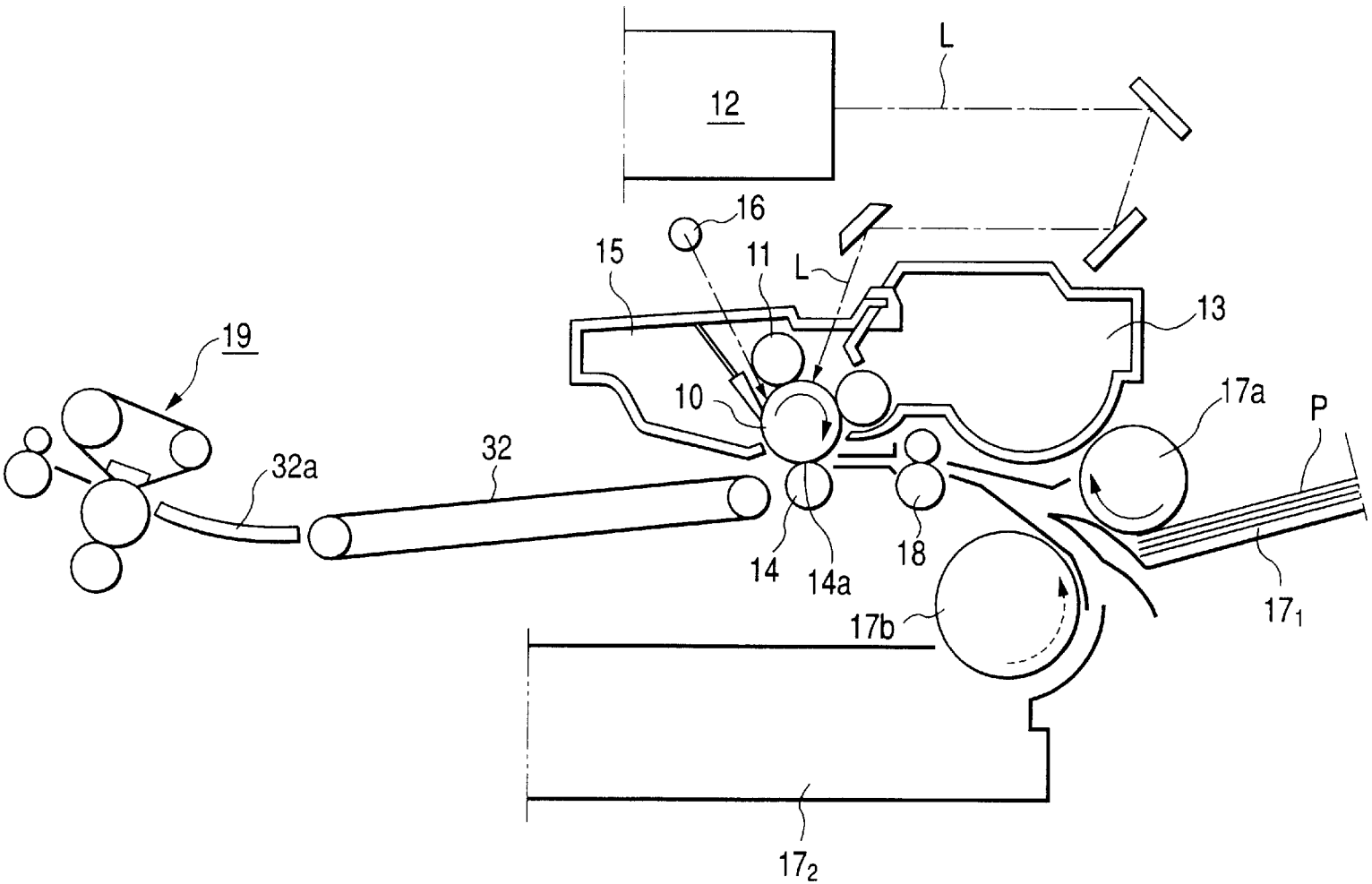
FIG. 1 is a schematic sectional view of an image forming apparatus according to a preferred embodiment of the present invention.

FIG. 1 is a schematic constructural view showing an example of an image forming apparatus according to the present invention. In this example, the image forming apparatus is embodied as a laser beam printer utilizing transfer-electrophotographic process.

A drum-shaped electrophotographic photosensitive member as an image bearing member (referred to as "photosensitive drum" hereinafter) 10 is embodied as an OPC photosensitive drum having negative charging ability. The photosensitive drum 10 is rotated at a predetermined peripheral speed (process speed) in a clockwise direction shown by the arrow.

During image formation, the rotating photosensitive drum 10 is subjected to whole surface pre-exposure effected by a pre-exposure lamp (eraser lamp) 16 to remove electricity and then is uniformly charged negatively by a first charging device as a charge means (charge roller of contact type, in the illustrated embodiment). Then, the uniformly charged surface of the photosensitive drum 10 is subjected to laser scan exposure L from a laser scanner 12 to thereby form an electrostatic latent image corresponding to desired image information on the photosensitive drum. The laser scanner 12 emits a laser beam modulated in response to time-lapse electric digital pixel signals of the desired image information.

Then, the electrostatic latent image formed on the peripheral surface of the rotating photosensitive drum 10 is developed by a developing device 13 as a toner image. The developing device 13 according to the illustrated embodiment is an inversion developing device using one-component negative toner. The electrostatic latent image formed on the peripheral surface of the photosensitive drum is developed by adhering the toner to laser scan exposure bright portions.

The toner used in the illustrated embodiment is one-component negative toner having volume average particle diameter of about 7 $\mu$m, and binding resin of the toner is polyester. A glass transition temperature (Tg) of the toner is about 60° C. and a softening temperature or fixing permitting temperature (Tm) of the toner is about 130° C.

On the other hand, transfer materials (recording materials) P from a first sheet supply portion $\mathbf{17}_1$ or a second sheet supply portion $\mathbf{17}_2$ are separated one by one by means of a sheet supply roller 17*a* or a sheet supply roller 17*b*, and the separated transfer material is introduced, by a pair of regist rollers 18 at a predetermined timing, to a transfer station 14a which is defined by a abut nip between the rotating photosensitive drum 10 and a transfer roller (transfer means) 14 urged against the photosensitive drum. While the transfer material is being conveyed through the transfer station 14*a*, the toner image on the photosensitive drum 10 is electrostatically transferred onto a surface of the transfer material P by applying transfer bias to the transfer roller 14.

The transfer material P to which the toner image was transferred at the transfer station 14*a* is separated from the rotating photosensitive drum 10 and then is conveyed, by a conveying device 32 and a guide 32*a*, to a fixing device 19, where the non-fixed toner image is fixed to the transfer material as a permanent image. Thereafter, the transfer material is discharged from the apparatus as an imaged product (copy, print).

After the toner image was transferred to the transfer material P, residual toner remaining on the surface of the photosensitive drum 10 is removed by a cleaning device 15, thereby preparing for next image formation.

Incidentally, in the printer according to the illustrated embodiment, the photosensitive drum 10, charge roller 11, developing device 13 and cleaning device 15 (four process means) are incorporated together as a process cartridge which can detachably mounted to the printer.

Figure 2:
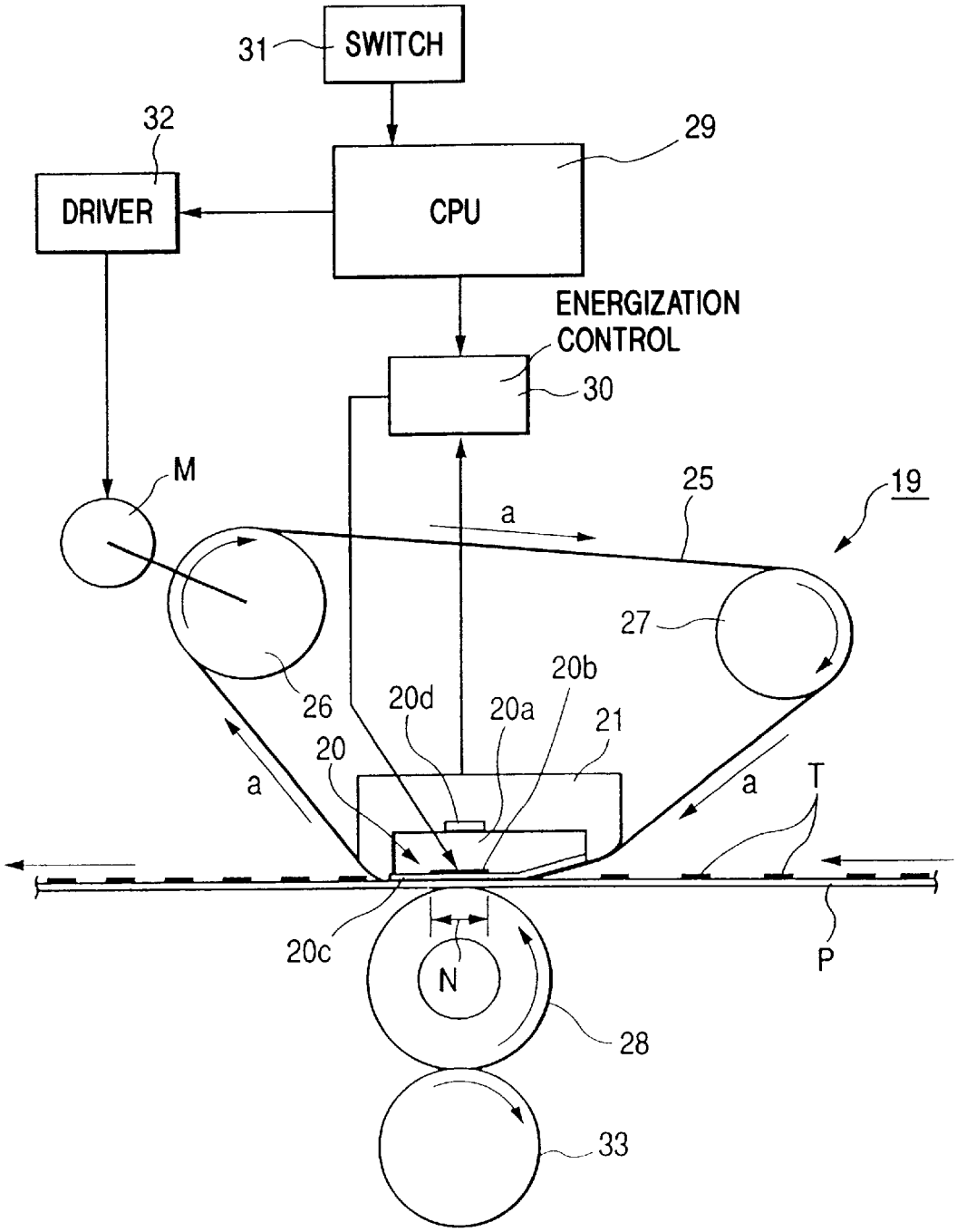
FIG. 2 is a constructural view showing a fixing apparatus of film type.
Figure 7:
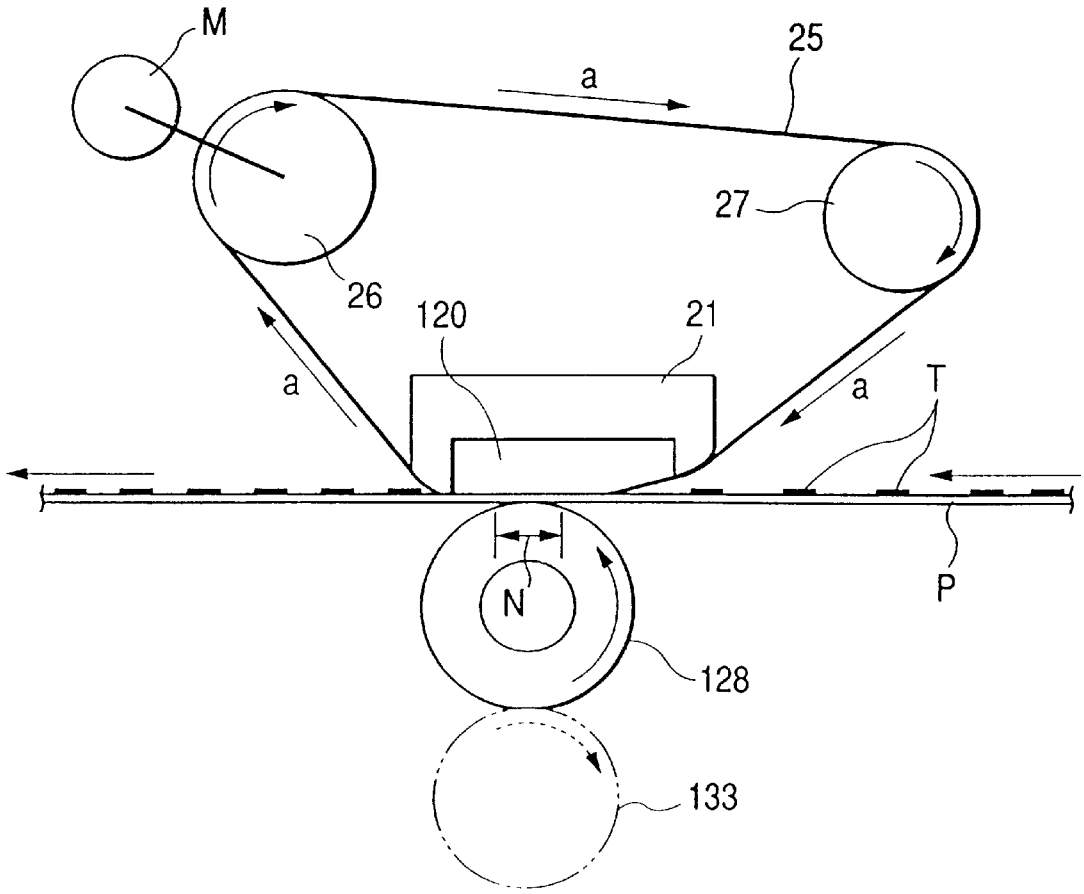
FIG. 7 PRIOR ART
FIG. 7 is a view showing a conventional fixing apparatus of film type.

FIG. 2 is a schematic constructural view showing the fixing apparatus according to the illustrated embodiment. Since the fixing apparatus according to the illustrated embodiment has substantially the same construction as that of the conventional fixing apparatus of film fixing type already described in connection with FIG. 7, the same elements are designated by the same reference numerals and explanation thereof will be omitted.

A heater 20 is embodied as a ceramic heater. More specifically, the heater 20 according to the illustrated embodiment comprises a ceramic substrate (heater substrate) 20*a* made of, for example, alumina or aluminum nitride having electrically insulating ability, heat-resisting ability and good heat conducting ability and having a thickness of 1 mm, a width of 10 mm and a length of 350 mm, an electrical resistor material layer (heat generating layer) 20*b* made of, for example, Ag/Pd coated on the substrate and having a width of 2.5 mm and a length of 300 mm, a surface protection layer 20*c* made of heat-resisting glass and the like and coated on the substrate, and a temperature sensor 20*d* such as a thermistor provided on the surface of the substrate. The heater 21 is secured to and supported by a stay 21 with the surface of the substrate (on which the electrical resistor material layer 20*b* and the surface protection layer 20*c* are formed) facing downwardly.

The entire heater 20 has small heat capacity, so that a temperature of the entire heater can be increased quickly by applying electricity to the electrical resistor material layer 20*b* to heat the latter. The temperature of the heater (more specifically, temperature of the heater substrate) is detected by the temperature sensor 20*d*, and detected temperature information is sent to an energization control portion (energization control means) 30.

The energization control portion 30 serves to control electric power to be supplied to the heater 20 (more specifically, electrical resistor material layer 20*b*) in response to heater temperature information detected by the temperature sensor 20*d* so that the temperature of the heater 20 is temperature-adjusted to a predetermined set temperature (fixing temperature) during the image formation.

Since the rotating fixing film 25 is used to thermally fix the toner image repeatedly, a film having good heat-resisting ability, good mold releasing ability and good anti-wear ability and having a total thickness of 100 $\mu$m or less (preferably, 40 $\mu$m or less) is used as the fixing film. For example, a single layer film made of heat-resisting resin such as polyimide, polyether imide or PES, or a laminated layer film in which a layer made of such heat-resisting resin is coated by a fluororesin layer made of PFA, PTFE or FEP may be used. A peripheral length of the film is 30 mm to 60 mm.

An endless fixing film 25 formed by coating material having good mold releasing property on high heat-resisting material and mounted on a drive roller 26 and a driven roller 27 (which are disposed substantially in parallel with the heater 20) is slidingly contacted with the heater 20. A heating means is constituted mainly by the heater 20 and the film 25.

A pressure roller (back-up member) 28 has an elastic rubber layer made of silicone rubber and the like having good mold releasing ability (and, preferably, a fluororesin layer coated on the elastic rubber layer and made of PFA, PTFE or FEP having mold releasing ability greater than that of the elastic rubber layer), and an outer diameter of the pressure roller is selected to 20 mm to 30 mm. The pressure roller is urged against the lower surface of the heater 20 by a biasing means (not shown) with total pressure of about 5 kg with the interposition of the fixing film 25, thereby forming a fixing nip N between the heater and the pressure roller.

When the drive roller 26 is rotated by a drive motor (rotation driving means) M in a direction shown by the arrow, the fixing film 25 subjected to predetermined tension from the driven roller 27 (also acting as a tension roller) is rotated at a predetermined peripheral speed in a direction shown by the arrow a, and the pressure roller 28 is rotatingly driven in an anti-clockwise direction by movement of the fixing film 25.

In a condition that the fixing film 25 is rotatingly driven and the heater 20 is heated and heat-adjusted to a predetermined temperature, the transfer material P (on which the non-fixed toner image T was formed) outputted from an image forming means is introduced between the fixing film 25 and the pressure roller 28 at the fixing nip N with the imaged surface facing the fixing film 25, so that the transfer material P is conveyed through the fixing nip N together with the fixing film 25 with the imaged surface of the transfer material closely contacted with the outer surface of the fixing film 25; meanwhile, the non-fixed toner image T is thermally fixed to the surface of the transfer material P by thermal energy from the heater 120 via the fixing film 25. The transfer material P passed through the fixing nip N is separated from the outer surface of the fixing film 25 and is discharged. In a stand-by condition, the heater 20 is not energized. The heater is energized when an image formation start signal is received.

An aluminum roller 33 is urged against a lower portion of the pressure roller 28 by a biasing means (not shown) with total pressure of 500 g to 2 kg. An outer diameter of the roller 33 is selected to 10 mm. The roller 33 is rotatingly driven by rotation of the pressure roller 28.

If the roller 33 is not provided, when transfer materials P having a width smaller than a length of the heater 20 are successively treated, temperatures of the heater 20, fixing film 25 and pressure roller 28 are considerably increased at areas where these elements are not contacted with the transfer material P to thereby cause thermal damage of the elements, resulting in local temperature increase (increase in temperature at no sheet passing areas).

When the roller 33 is provided, the roller 33 is rotatingly driven in a clockwise direction by rotation of the pressure roller 28. As a result, temperature distribution (in an axial direction) of the pressure roller 28 contacted with the roller 33 is made uniform, since the roller 33 has good heat conductivity. Thus, temperature distribution (in a longitudinal direction) of the heater 20 and the fixing roller 25 (as well as the pressure roller 28) can be made uniform to thereby prevent or suppressing the above-mentioned local temperature increase. That is to say, the roller 33 acts as a member for preventing the local temperature increase of the fixing apparatus 19.

The toner adhered to the surface of the pressure roller 28 can be removed or collected, since surface energy of the roller 33 is greater than that of the pressure roller 28. Accordingly, the roller 33 also acts as a cleaning member for cleaning the pressure roller 28.

Particularly, when a surface temperature of the roller 33 is increased up to a temperature greater than 60° C. which is glass transition temperature of the toner used in the illustrated embodiment (preferably, greater than the glass transition temperature by 10° C. or more, and more preferably, greater than the glass transition temperature by 20° C. or more), the toner contacted with the roller 33 is thermally deformed to be closely contacted with the roller 33. Accordingly, in a condition that the temperature of the roller 33 is maintained to 60° C. to 80° C. or more, when the roller 33 is rotated while contacting with the pressure roller 28 for a predetermined time period, the toner on the pressure roller 28 can be removed.

In the present invention, during control sequence of the image forming apparatus using the fixing apparatus of film fixing type, by providing a cleaning process for the pressure roller (rotatable pressurizing member) 28 to improve cleaning ability of the roller 33 for the pressure roller, spotted contamination of the transfer material (recording material) caused by toner contamination of the pressure roller 28 can be prevented, so that good fixed imaged products can always be obtained for a long time. The details will be described later.

Figure 3:
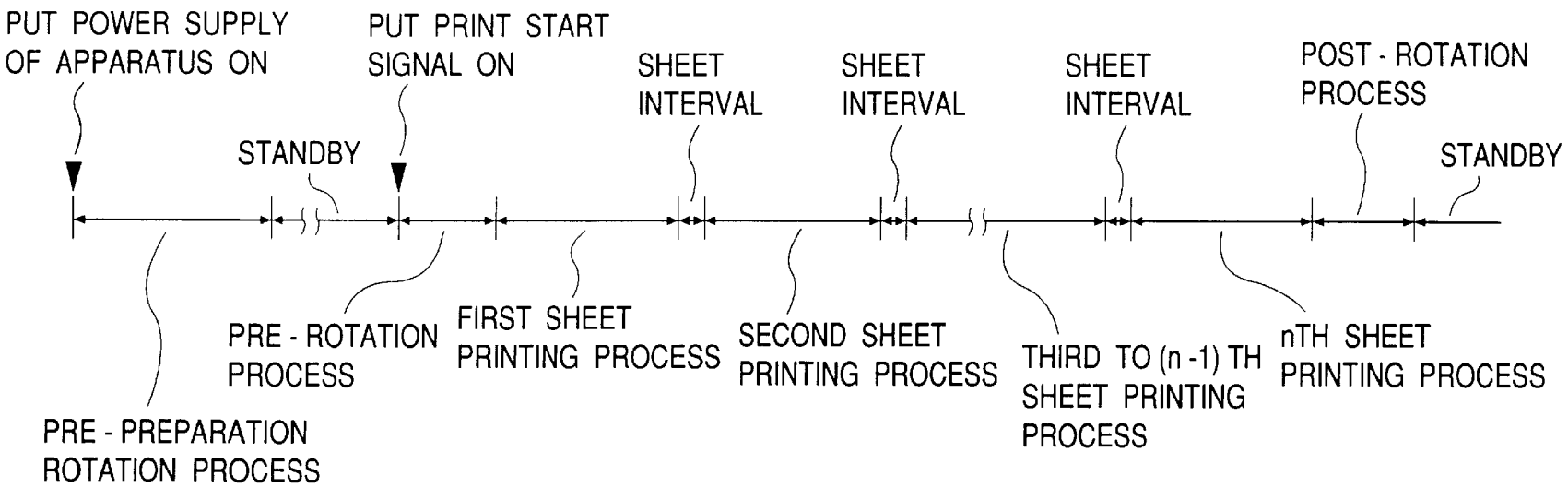
FIG. 3 is a view showing an operation sequence of the image forming apparatus.

FIG. 3 shows operation sequence of the image forming apparatus (printer) according to the illustrated embodiment.

(a) Pre-preparation Rotation Process (Pre-multi Rotation Process)

This process is start operation period (warming period) of the image forming apparatus. By putting a main power supply switch ON, a main motor (not shown) of the apparatus is driven to rotate the photosensitive drum 10 to carry out preparation operation of required process means.

After the predetermined start operation period of the image forming apparatus is finished, the driving of the main motor is once stopped to stop the photosensitive drum to thereby establish a stand-by (waiting) condition until a print start signal is inputted.

(b) Pre-rotation Process

In response to the print start signal (image formation start signal), the main motor is driven again to rotate the photosensitive drum 10 again to carry out a pre-print operation of the apparatus for a while. In this process, the film 25 is also rotated.

(c) Printing Process (Image Forming Process)

After the predetermined pre-rotation process is finished, a printing process (image forming process) including predetermined sequence such as pre-exposure, charging, image exposure, development (with respect to the photosensitive drum 10) and transferring of toner image to the transfer material (recording material) is performed, and the transfer material P to which the toner image was transferred is conveyed to the fixing apparatus 19. In this way, a first sheet is printed.

In a continuous print mode, the printing process is repeated until the predetermined number (n) of prints are obtained.

(d) Sheet Interval Process

In the continuous print mode, this process is a period during which the transfer material P is not passed through the transfer station 14*a* until a tip end of a next transfer material P reaches the transfer station 14*a* after a trail end of the first transfer material P is passed through the transfer station 14*a*. In the illustrated embodiment, this period is selected to about one second.

(e) Post-rotation Process

Even after the printing process for a last transfer material (n-th transfer material) is finished, the driving of the main motor is continued for a while to rotate the photosensitive drum 10 to carry out predetermined post-operation of the apparatus. In this process, the film 25 is also rotated.

When the predetermined post-rotation process is finished, the driving of the main motor is stopped to stop the photosensitive drum 10, with the result that the apparatus is maintained in the stand-by condition until a next print start signal is inputted.

When the print start signal is inputted immediately after the pre-preparation rotation process, the pre-rotation process is carried out and then the printing process is performed. When a single print is desired, after the printing process is finished, the post-rotation process is carried out and the stand-by condition of the apparatus is restored.

The image forming operation corresponds to the printing process and the sheet interval process. The pressure roller 28 is always contacted with the cleaning roller 33. During the pre-rotation process and the post-rotation process, a first cleaning mode in which the image forming operation is not performed and the pressure roller 33 is cleaned by the cleaning roller 33 is established. In the illustrated embodiment, a time period of the first cleaning mode is selected to about two seconds in the pre-rotation process and in the post-rotation process.

The image forming apparatus according to the present invention includes a recording means for recording the number of transfer materials to which the fixing was effected by the fixing apparatus 19, and a rotation control means for providing a pressure roller cleaning process (second cleaning mode) (different from the first cleaning mode) in which at least the roller 33 and the pressure roller 28 are rotated for a predetermined time period (predetermined interval) after every fixing operation is effected regarding to the predetermined number of transfer materials.

More specifically, in FIG. 2, there is provided a main control portion (CPU) 29 for controlling the entire image forming apparatus. The energization control portion 30 is controlled by the main control portion 29. The drive motor M for the drive roller 26 is controlled by the main control portion 29 through a driver 32. The main control portion 29 has a recording means function (counter function portion) for recording (counting) the number of transfer materials to which the fixing was effected by the fixing apparatus 19.

Further, the main control portion 29 has a rotation control means function for providing a pressure roller cleaning process in which at least the roller 33 and the pressure roller 28 are rotated for a predetermined time period whenever the fixing operation was effected regarding to the predetermined number of transfer materials.

There is provided a pressure roller cleaning mode selection switch 31 for selecting and setting modes (performing conditions) of the pressure roller cleaning process effected by the main control portion 29.

The drive motor M can be rotated at a predetermined timing in response to a detection signal selected by the pressure roller cleaning mode selection switch 31.

In the pressure roller cleaning process, the energization control portion 30 can temperature-adjust the heater 20 for a predetermined time period with a predetermined temperature-adjusted temperature in response to the detection signal selected by the pressure roller cleaning mode selection switch 31, in synchronous with the operation of the drive motor M.

Now, the pressure roller cleaning process according to the illustrated embodiment will be explained.

When the number recorded in the counter function portion for counting the number of transfer materials to which the fixing was effected by the fixing apparatus 19 reaches a predetermined value, the main control portion 29 drives the drive motor through the driver 32 for a predetermined time period at a predetermined timing to rotate the fixing film 25 and the pressure roller 28 and adjusts the temperature of the heater 20 via the energization control portion 30 and performs the second cleaning mode pressure roller cleaning process. In the other case (when the predetermined number is not reached), the first cleaning mode is selected. Hereinbelow, the setting and changing of the cleaning process will be described in connection with only the second cleaning mode.

Regarding the pressure roller cleaning process performed by the main control portion 29, the following conditions can be desirably selected and set.

(i) presence/absence of performance of the pressure roller cleaning process;

(ii) timing for performing the pressure roller cleaning process;

(iii) time interval from when one pressure roller cleaning process was performed to when a next pressure roller cleaning process is performed;

(iv) time period for performing one pressure roller cleaning process; and (v) temperature adjustment conditions of the heater in the pressure roller cleaning process.

More specifically, "presence" or "absence" can be set regarding the presence/absence of performance of the pressure roller cleaning process, "immediately before" (pre-rotation) or "immediately after" (post-rotation) the fixing operation can be set regarding the timing for performing the pressure roller cleaning process, and the time interval, time period and heater temperature adjustment conditions can freely be set.

In the first embodiment, the conditions for the pressure roller cleaning process are set as follows:

(1) "presence" of performance of the pressure roller cleaning process;

(2) "immediately after" (post-rotation) the fixing operation regarding the timing for performing the pressure roller cleaning process;

(3) 1000 sheets regarding the time interval from when one pressure roller cleaning process was performed to when a next pressure roller cleaning process is performed;

(4) 60 seconds regarding the time period for performing one pressure roller cleaning process; and (5) 230° C. (constant) regarding the temperature adjustment condition of the heater in the pressure roller cleaning process.

The timing for performing the pressure roller cleaning process is in the post-rotation. At this time period, since the image forming operation is not performed and the conveyance of the transfer material is not effected in the apparatus, there is no transfer material in the fixing nip of the fixing apparatus during the cleaning process. The time period for performing the cleaning process is sufficiently longer than the period of the sheet interval at the fixing nip during the continuous image formation. Further, the time period for performing the cleaning process (second cleaning mode) is sufficiently longer than the time period for performing the first cleaning mode.

When A4 size sheet having bad fixing ability (for example, sheet including a large amount of filler (talc, $CaCO_3$, etc.), thick sheet or sheet having a bad surface (for example, watermarked sheet)) is used as the transfer material P and images having image ratio of 5% are successively outputted intermittently at an interval in which one print is obtained by five minutes, it was found that a saturated temperature of the roller 33 is about 35° C. (in case of room temperature of 15° C.).

When the images are outputted in such a mode, as mentioned above, the part of the toner image on the transfer material P is transferred onto the pressure roller 28 through the fixing film 25. However, since the temperature of the roller 33 is smaller than the glass transition temperature of the toner, the toner on the pressure roller 28 is almost not transferred to the roller 33.

Figure 4:
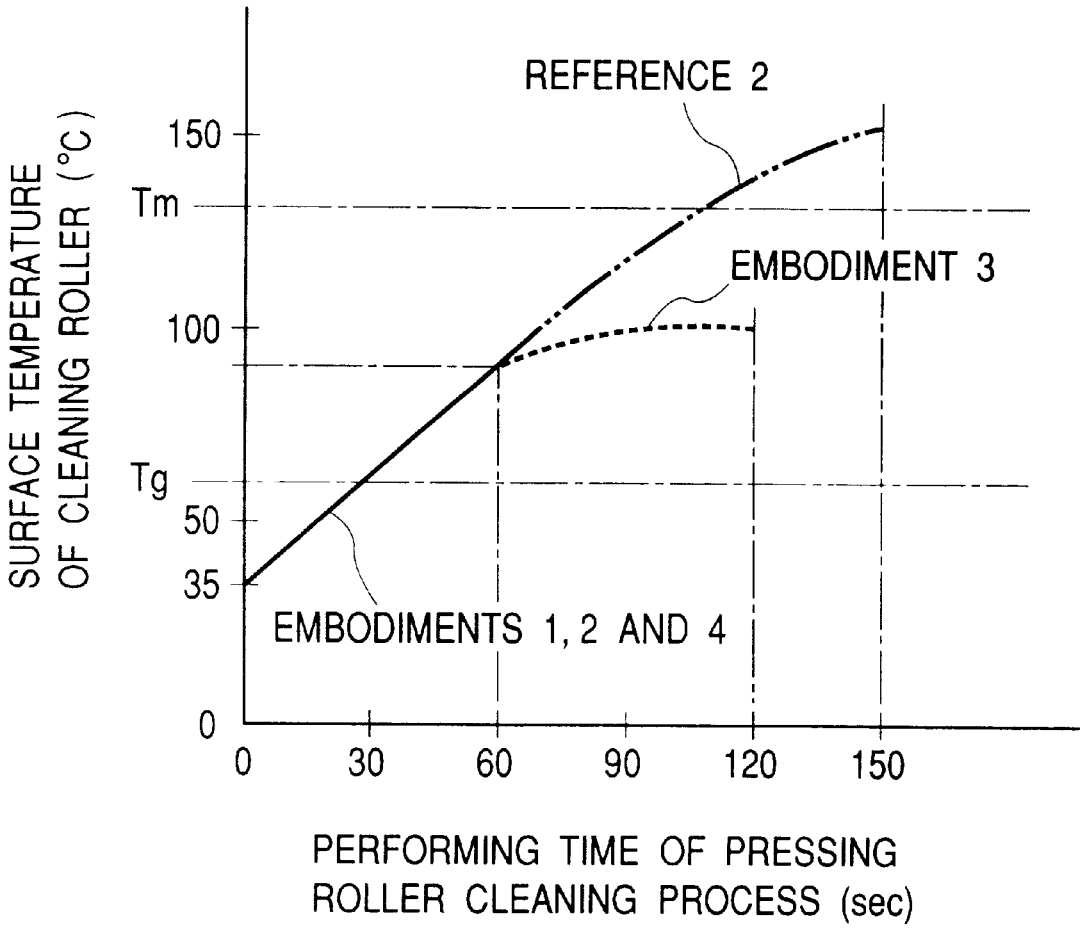
FIG. 4 is a graph showing a relation between a cleaning time and a temperature of a cleaning member.

FIG. 4 is a graph showing change in the surface temperature of the roller 33 and time in the pressure roller cleaning process.

In case of the illustrated embodiment, the temperature of the roller 33 reaches the temperature Tg (glass transition temperature of the toner, since the roller 33 is heated by the heater 20 through the fixing film 25 and the pressure roller 28; about 60° C. in the illustrated embodiment) for about 30 seconds and reaches a temperature "Tg+10° C." for 40 seconds, a temperature "Tg+20° C." for 50 seconds and "Tg+30° C." (=90° C.) for 60 seconds. Accordingly, in the embodiment 1, the time period during when the surface temperature of the roller 33 is maintained above the temperature Tg in the pressure roller cleaning process is about 30 seconds.

While 1000 transfer materials are being treated, although the pressure roller 28 is slightly contaminated by toner, by effecting the pressure roller cleaning process, all of the toner on the pressure roller 28 is removed by the roller 33. Accordingly, the thin toner layer is not formed on the pressure roller 28.

When the images continue to be outputted by using the sequence for performing the pressure roller cleaning process in the above-mentioned mode whenever 1000 transfer materials are treated, it was found that contamination of the image is not generated for 10000 to 100000 sheets.

If 150000 sheets are outputted, unevenness of the toner collected on the roller 33 becomes noticeable. As a result, a contact area between the pressure roller 28 and the roller 33 is actually decreased and heat transmitting efficiency to the roller 33 is also decreased. Consequently, a small amount of toner is remained on the surface of the pressure roller 28 and the adhering force of the toner collected on the roller 33 (to the roller 33) is decreased. However, at this point, there is no practical problem regarding the contamination of the image.

However, if 30000 sheets are outputted, since the unevenness of the toner accumulated on the surface of the roller 33 becomes great to further decrease the contact area between the pressure roller 28 and the roller 33, the amount of residual toner remaining on the pressure roller 28 is increased and the adhering force of the toner collected on the roller 33 (to the roller 33) is further decreased. In this condition, after a long term pause, when the image is outputted, in the pre-rotation, the temperature of the toner collected on the roller 33 is increased up to a temperature higher than the glass transition temperature Tg by 20° C. to 60° C. by the heater 20 via the fixing film 25 during the pre-rotation, so that the toner is peeled by the pressure roller 28 having the increased adhering force to the toner. The toner transferred to the pressure roller is adhered to the fixing film 25 together with the toner remained on the pressure roller 28 during the pre-rotation of the fixing apparatus 19, so that the unacceptable contamination of the image is generated. Accordingly, in the embodiment 1, the roller 33 may be exchanged after 150000 sheets are outputted.

Table 1 shows fixing ability of the used transfer material P, modes (conditions) of the performed pressure roller cleaning process, temperature of the roller 33 and image contamination, regarding the embodiment 1, embodiments 2 to 5 (described later) and references 1 and 2.

TABLE 1

| | Fixing | Pressure roller cleaning process | | | Roller 33 | | Image contamination | | | |
|---|---|---|---|---|---|---|---|---|---|---|
| | ability of used transfer material | Performing interval (sheets) | Performing timing | Heater adjustment temperature (° C.) × Cleaning time (sec) | Maximum reach temperature (° C.) | Time greater than Tg (*) | 5000 sheets | 10000 sheets | 150000 sheets | 300000 sheets |
| Embodiment 1 | Bad | 1000 | Post-rotation | 230 × 60 | 90 | 30 | ○ | ○ | Δ | x |
| Embodiment 2 | Bad | 1000 | Pre-rotation | 230 × 60 | 90 | 30 | ○ | ○ | ○ | Δ |
| Embodiment 3 | Bad | 1000 | Post-rotation | 230 × 60 after 130 × 60 | 100 | 90 | ○ | ○ | ○ | ○ |
| Embodiment 4 | Normal | 5000 | Post-rotation | 230 × 60 | 90 | 30 | ○ | ○ | ○ | ○ |
| Embodiment 5 | Worst | 250 | Post-rotation | 230 × 60 after 130 × 60 | 100 | 90 | ○ | ○ | ○ | Δ |
| Reference 1 | Bad | Not performed | — | — | 35 | 0 | Δ | x | — | — |
| Reference 2 | Bad | 1000 | Post-rotation | 230 × 150 | 150 | 120 | x | x | — | — |

*Time period (sec) for performing pressure roller cleaning process in a condition that surface temperature of roller 33 is kept above Tg
○ . . . No problem
Δ . . . Practically OK
x . . . Practically NO
— . . . Not evaluated In this way, according to the illustrated embodiment, since the temperature of the cleaning roller 3 is maintained to 60° C. to 90° C. higher than the glass transition temperature of the toner during at least a part of the cleaning process, the toner on the pressure roller can be thermally deformed to permit the complete cleaning of the pressure roller to thereby prevent the toner contamination of the transfer material.

Further, according to the illustrated embodiment, it is not that the pressure roller is cleaned by the cleaning roller merely following the image forming operation, but that the sufficiently long (60 seconds) cleaning process (second cleaning mode) is effected without performing the image forming operation, thereby cleaning the pressure roller positively.

Further, according to the illustrated embodiment, since the transfer material is not existed at the fixing nip during the cleaning process, the heat from the heater 20 is not absorbed by the transfer material, so that, during the cleaning process, the cleaning roller can be heated faster by the heater 20 for fixing the toner image.

<Reference 1>

Regarding the reference 1, in the image forming apparatus according to the first embodiment, "absence" of the pressure roller cleaning process is selected by the pressure roller cleaning mode selection switch 31.

In the mode for "absence" of the pressure roller cleaning process, when the image is outputted, the toner on the pressure roller 28 is almost not transferred to the roller 33, since the saturated temperature of the roller 33 is about 35° C. lower than the glass transition temperature Tg (about 60° C.) of the toner.

Thus, in the reference 1, it was found that, after about 5000 sheets are outputted, the image contamination is generated, and, after 10000 sheets are outputted, practically unacceptable level is reached.

<Second Embodiment (Embodiment 2)>

According to a second embodiment of the present invention, in the image forming apparatus according to the first embodiment, the conditions of the pressure roller cleaning process are selected as follows:

(1) "presence" of performance of the pressure roller cleaning process;

(2) "immediately before" (pre-rotation) the fixing operation regarding the timing for performing the pressure roller cleaning process;

(3) 1000 sheets regarding the time interval from when one pressure roller cleaning process was performed to when a next pressure roller cleaning process is performed;

(4) 60 second regarding the time period for performing one pressure roller cleaning process; and (5) 230° C. (constant) regarding the temperature adjustment condition of the heater in the pressure roller cleaning process.

The timing for performing the pressure roller cleaning process is in the pre-rotation. At this time period, there is no transfer material in the fixing nip of the fixing apparatus during the cleaning process, since the image forming operation is not performed and the conveyance of the transfer material is not effected in the apparatus.

In case of the embodiment 2, regarding the image contamination, it was found that the image contamination is not generated even when a small amount of toner is remained on the pressure roller 28 as a result of the fact that the unevenness of the toner collected on the roller 33 is increased to reduce the contact area between the pressure roller 28 and the roller 33 after about 150000 sheets were outputted.

The reason is considered as follows. That is to say, at initial several seconds of the pressure roller cleaning process, the temperature of the toner collected on the roller 33 is increased up to a temperature higher than the glass transition temperature Tg by 20° C. to 60° C. by the heater 20 via the fixing film 25 during the cleaning process, so that the toner is peeled by the pressure roller 28 having the increased adhering force to the toner. The toner transferred to the pressure roller is adhered to the fixing film 25 together with the toner remained on the pressure roller 28 during front half of the pressure roller cleaning process. However, unlike to the normal image output pre-rotation, the toner is returned from the fixing film 25 to the pressure roller again during rear half of the pressure roller cleaning process (due to the difference in mold releasing ability including temperature factor). The image contamination is not generated, since the transfer material is outputted in this condition. It was found that the image contamination is in the practically acceptable level even after 300000 sheets are outputted.

In this way, in the embodiment 2, the service life of the roller 33 in the image forming apparatus according to the embodiment 2 can be lengthened in comparison with the image forming apparatus according to the embodiment 1, since the waiting time of 60 seconds is generated prior to the image output whenever 1000 transfer materials are outputted. However, the operability is slightly worsened.

<Third Embodiment (Embodiment 3)>

In a third embodiment of the present invention, default (initial setting) of the image forming apparatus and the pressure roller cleaning mode selection switch 31 is the same as that of the image forming apparatus according to the first embodiment, and the conditions of the pressure roller cleaning process are selected by switching the switch 31, as follows:

(1) "presence" of performance of the pressure roller cleaning process;

(2) "immediately after" (post-rotation) the fixing operation regarding the timing for performing the pressure roller cleaning process;

(3) 1000 sheets regarding the time interval from when one pressure roller cleaning process was performed to when a next pressure roller cleaning process is performed;

(4) 120 seconds regarding the time period for performing one pressure roller cleaning process; and (5) regarding the temperature adjustment condition of the heater in the pressure roller cleaning process, after the temperature adjustment is effected with 230° C. for 60 seconds, the temperature adjustment is effected with 130° C. for 60 seconds.

In the embodiment 3, it was found that the image contamination is not generated even after about 300000 sheets are outputted.

The reason is considered as follows. That is to say, in the graph (FIG. 4) showing the relation between the temperature of the roller 33 and the time in the pressure roller cleaning process, in case of the embodiment 3, since the roller 33 is heated by the heater 20 through the fixing film 25 and the pressure roller 28, similar to the embodiments 1 and 2, the temperature of the roller 33 reaches the glass transition temperature Tg (about 60° C.) of the toner for about 30 seconds and reaches 90° C. (Tg+30° C.) for 60 seconds. Thereafter, by reducing the temperature-adjustment temperature to 130° C., the surface temperature is changed as shown by the broken line, so that heat amount supplied to the roller 33 is substantially balanced with heat discharged from the roller 33. As a result, in the rear half of the pressure roller cleaning process which thereafter continues for 60 seconds, the roller 33 is rotated together with the pressure roller 28 while being urged against the pressure roller in a condition that the temperature of the roller 33 is maintained between (Tg+30° C.) and (Tg+40° C.). Consequently, the toner on the surface of the roller 33 is effectively squeezed to reduce the unevenness of the toner considerably in comparison with the embodiment 1. For the same reason, the adhering force of the toner to the roller 33 is increased.

In this way, in the third embodiment, since the temperature-adjustment temperature of the heater and the cleaning time can be changed and the ability for cleaning the pressure roller 28 is maintained for a long time, the amount of the residual toner remaining on the pressure roller 28 after the pressure roller cleaning process is very small, so that the toner is hard to be returned from the roller 33 to the pressure roller 28.

Accordingly, the thin toner layer is not formed on the surface of the pressure roller 28. As a result, in the image forming apparatus according to the third embodiment, the service life of the roller 33 is lengthened in comparison with the first embodiment.

On the other hand, in the third embodiment, the pressure roller cleaning process of 120 seconds (twice in the first embodiment) is generated after image output whenever 1000 transfer materials are outputted. However, during the pressure roller cleaning process, the image output may be effected. If the pressure roller cleaning process is interrupted by effecting the image output, after the image output is finished, the remaining pressure roller cleaning process may be performed.

<Reference 2>

In a reference 2, the default of the image forming apparatus and the pressure roller cleaning mode selection switch 31 is the same as that of the image forming apparatus according to the first embodiment, and the conditions of the pressure roller cleaning process are selected by switching the switch 31, as follows:

(1) "presence" of performance of the pressure roller cleaning process;

(2) "immediately after" (post-rotation) the fixing operation regarding the timing for performing the pressure roller cleaning process;

(3) 1000 sheets regarding the time interval from when one pressure roller cleaning process was performed to when a next pressure roller cleaning process is performed;

(4) 150 seconds regarding the time period for performing one pressure roller cleaning process; and (5) regarding the temperature adjustment condition of the heater in the pressure roller cleaning process, the temperature adjustment is effected with 230° C. for 150 seconds.

In an image forming apparatus according to the reference 2, it was found that the image contamination is generated after 5000 sheets are outputted.

The reason is considered as follows. That is to say, in the graph (FIG. 4) showing the relation between the temperature of the roller 33 and the time in the pressure roller cleaning process, in case of the reference 2, since the roller 33 is heated by the heater 20 through the fixing film 25 and the pressure roller 28, similar to the embodiments 1 and 2, the temperature of the roller 33 reaches the glass transition temperature Tg (about 60° C.) of the toner for about 30 seconds and reaches 90° C. (Tg+30° C.) for 60 seconds. Thereafter, in the rear half of the pressure roller cleaning process which thereafter continues for 90 seconds, as shown by the two-dot and chain line, the temperature of the roller 33 is increased to 150° C. exceeding the softening temperature Tm (about 130° C.) of the toner. As a result, the toner on the surface of the roller 33 is effectively squeezed, but viscosity of the uppermost toner on the toner layer is decreased excessively. Consequently, a part of the uppermost toner is offset to the pressure roller 28. In this condition, after the entire fixing apparatus 19 is cooled due to the long term pause, when the image is outputted, the toner offset to the pressure roller 28 during the pre-rotation for the image output is transferred onto the fixing film 25 in the same mechanism as mentioned above, so that the transfer material P is contaminated by the transferred toner.

<Fourth Embodiment (Embodiment 4)>

In a fourth embodiment of the present invention, the default of the image forming apparatus and the pressure roller cleaning mode selection switch 31 is the same as that of the image forming apparatus according to the first embodiment, and the conditions of the pressure roller cleaning process are selected by switching the switch 31, as follows:

(1) "presence" of performance of the pressure roller cleaning process;

(2) "immediately after" (post-rotation) the fixing operation regarding the timing for performing the pressure roller cleaning process;

(3) 5000 sheets regarding the time interval from when one pressure roller cleaning process was performed to when a next pressure roller cleaning process is performed;

(4) 60 seconds, regarding the time period for performing one pressure roller cleaning process; and (5) regarding the temperature adjustment condition of the heater in the pressure roller cleaning process, the temperature adjustment is effected with 230° C. for 60 seconds.

In the fourth embodiment, when the test was carried out by using sheets having no problem regarding the fixing ability (for example, thin sheets, or sheet having good surface property), it was found that the image contamination is not generated after about 300000 sheets are outputted.

The reason is that, even when the frequency of the pressure roller cleaning processes is decreased to ⅕ (from 1000 sheets to 5000 sheets), since the amount of the toner offset to the fixing film 25 from the transfer material (sheet) P is reduced by using the sheet having no problem regarding the fixing ability as the transfer material P, the amount of toner transferred to the pressure roller 28 is reduced. In this way, in the fourth embodiment, the interval of the cleaning process can be changed in accordance with the kind of the transfer material, and, in dependence upon the kind of the transfer material used in the image forming apparatus, the frequency of the pressure roller cleaning processes can be decreased. As a result, the operability is improved.

<Fifth Embodiment (Embodiment 5)>

In a fifth embodiment of the present invention, the default of the image forming apparatus and the pressure roller cleaning mode selection switch 31 is the same as that of the image forming apparatus according to the first embodiment, and the conditions of the pressure roller cleaning process are selected by switching the switch 31, as follows:

(1) "presence" of performance of the pressure roller cleaning process;

(2) "immediately after" (post-rotation) the fixing operation regarding the timing for performing the pressure roller cleaning process;

(3) 250 sheets regarding the time interval from when one pressure roller cleaning process was performed to when a next pressure roller cleaning process is performed;

(4) 120 seconds regarding the time period for performing one pressure roller cleaning process; and (5) regarding the temperature adjustment condition of the heater in the pressure roller cleaning process, after the temperature adjustment is effected with 230° C. for 60 seconds, the temperature adjustment is effected with 130° C. for 60 seconds.

In the fifth embodiment, when the test was carried out by using sheets having very bad fixing ability (for example, bond sheets), it was found that the image contamination is not generated after about 150000 sheets are outputted. The reason is that, even when the amount of toner offset from the transfer material to the fixing film 25 is increased and the amount of toner transferred to the pressure roller 28 is increased, such toner can be removed completely by increasing the frequency and time period of the pressure roller cleaning process.

In this way, in the fifth embodiment, the interval and the time period of the pressure roller cleaning process can be changed in accordance with the kind of the sheet (transfer material), and, in dependence upon the kind of the transfer material used in the image forming apparatus, the frequency of the pressure roller cleaning processes can be increased and the time period of the pressure roller cleaning process can be lengthened. As a result, the kinds of transfer materials P which can be used is increased, to thereby improve versatility.

<Sixth Embodiment (Embodiment 6)>

Figure 5:
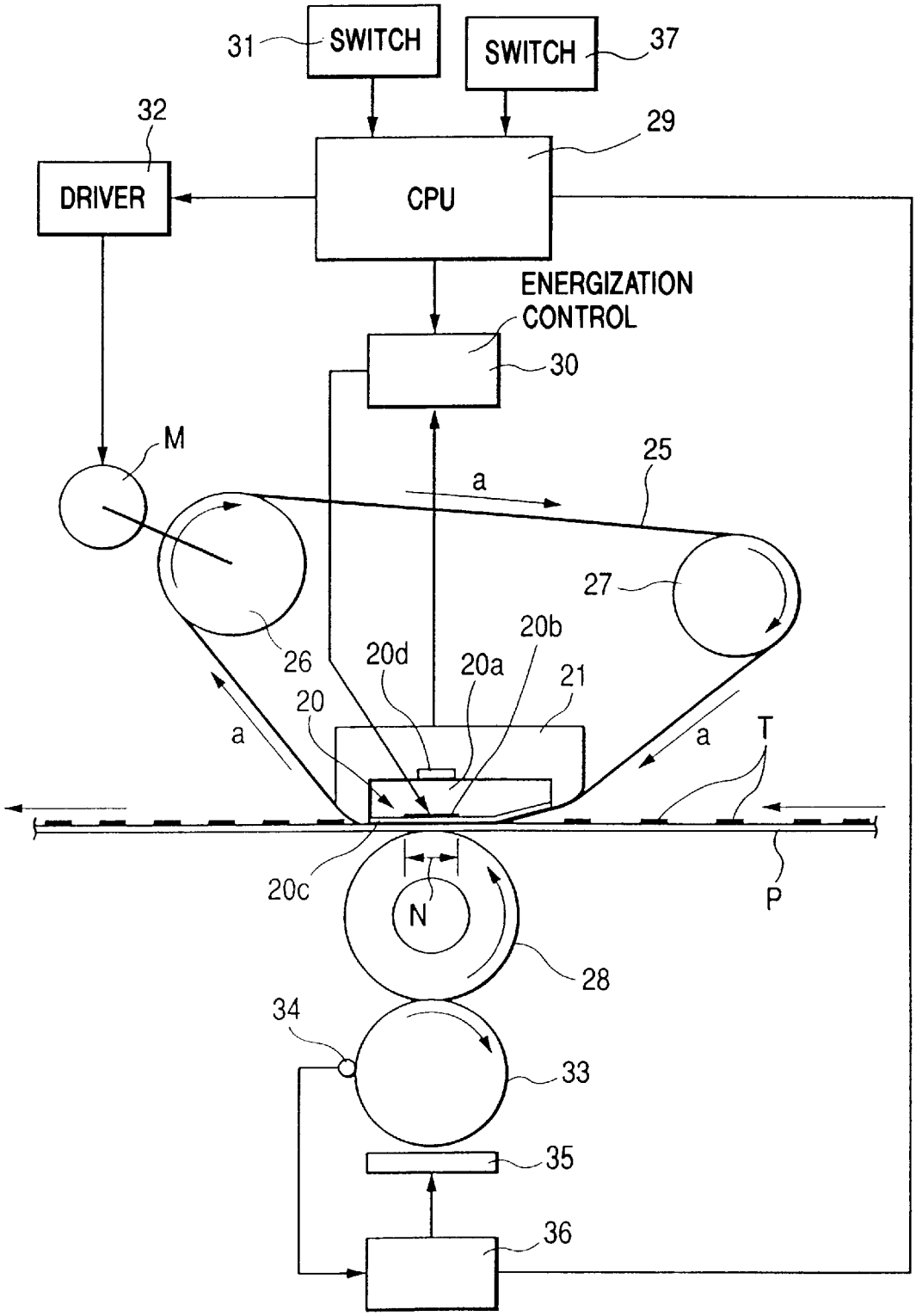
FIG. 5 is a constructural view showing a fixing apparatus according to another embodiment of the present invention.

In an image forming apparatus according to a sixth embodiment of the present invention, as shown in FIG. 5, regarding the fixing apparatus 19 shown in FIG. 2, there is provided a second temperature sensor 34 disposed in contact with or closely adjacent to the roller 33, and a second heater 35 disposed closely adjacent to the roller 33 and adapted to directly heat the roller 33. Both the second temperature sensor 34 and the second heater 35 are connected to a second energization control portion 36. The second energization control portion 36 is controlled by the main control portion 29. The other construction of the image forming apparatus is the same as that of the image forming apparatus according to the first embodiment.

In the image forming apparatus according to the sixth embodiment, the temperature of the roller 33 is detected by the second temperature sensor 34, and, when the detected temperature is lower than a predetermined temperature Tc (for example, 70° C. higher than the glass transition temperature Tg of the toner by 10° C.), the second heater 35 is energized by the energization control portion 36, so that the roller 33 is heated by heat from the second heater 35. The control temperature Tc can be changed by a second pressure roller cleaning mode selection switch 37 of the main control portion 29.

In this case, the time period of the pressure roller cleaning process can be reduced from 60 seconds (first embodiment) to about 10 to 20 seconds, since the temperature of the roller 33 prior to start of the pressure roller cleaning process can be maintained to a sufficiently high level.

Further, by maintaining the temperature of the roller 33 above the glass transition temperature Tg of the toner, the image contamination can be further suppressed, since the toner on the pressure roller 28 can be transferred to the roller 33 to some extent during the normal image output.

Incidentally, in the above-mentioned embodiments, while an example that the cleaning process is effected whenever the predetermined number of sheets are outputted was explained, when the predetermined number of sheets are outputted during the continuous image formation, the cleaning process may be performed after the continuous image formation is finished.

Figure 6A:
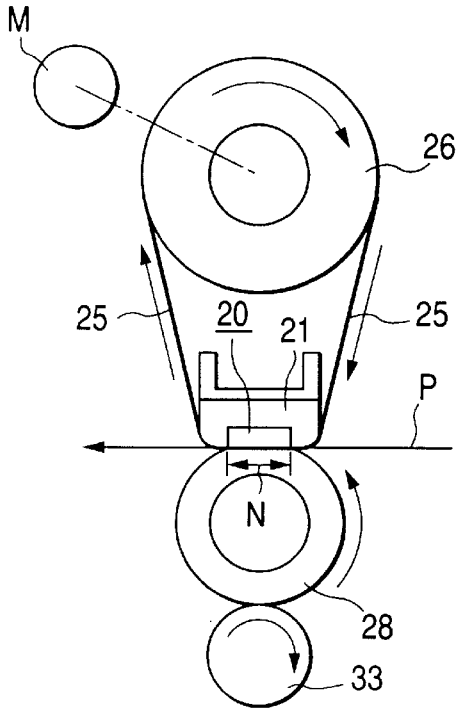
FIGS. 6A, 6B and 6C are views showing other fixing apparatuses to which the present invention can be applied.
Figure 6B:
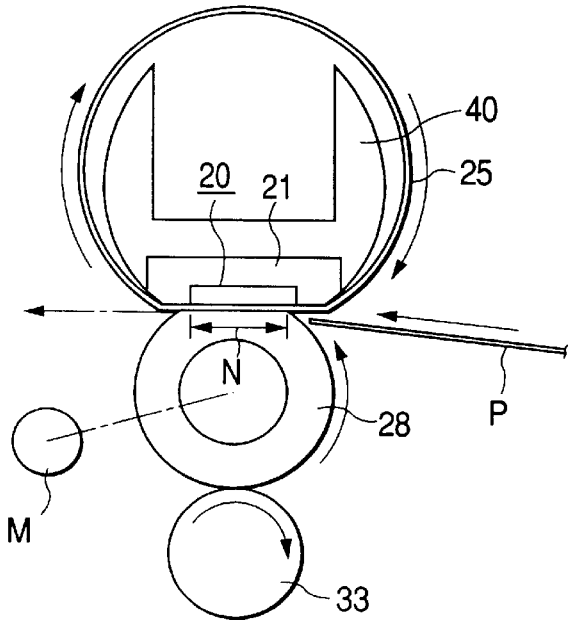
Figure 6C:
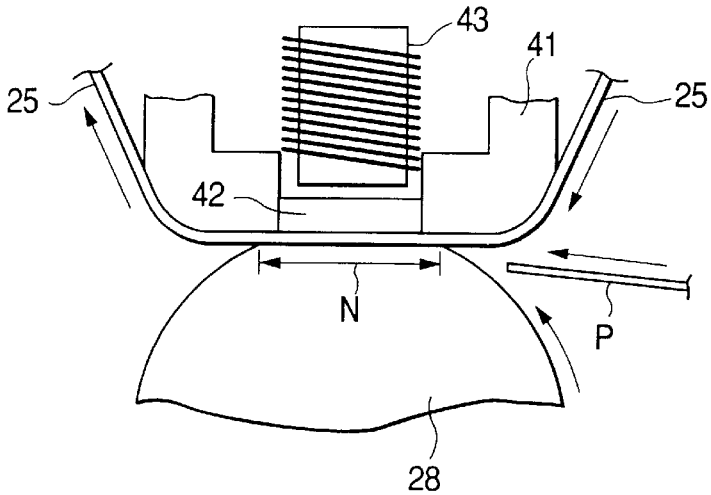

FIGS. 6A to 6C are schematic views showing examples of fixing apparatuses of film fixing type to which the present invention can be applied.

In a fixing apparatus shown in FIG. 6A, an endless fixing film 25 is wound around and mounted on a heater 20 supported by a stay 21 and a drive roller 26 and is rotatingly driven by the drive roller 26.

In a fixing apparatus shown in FIG. 6B, a cylindrical fixing film 25 is loosely mounted around a film guide member 40 holding a heater 20 via a stay 21, the fixing film 25 is urged against the heater 20 by a pressure roller 28, and the cylindrical fixing film 25 is rotated by rotating the pressure roller 28 while an inner surface of the fixing film is being slidingly contacted with the heater 20 (pressure roller driving type and tensionless type).

A fixing apparatus shown in FIG. 6C is of electromagnetic (magnetic) induction heating type. An electromagnetic induction heat generating magnetic metal member (for example, iron plate) 42 is supported by a heat-resisting stay or film guide member 41. A pressure roller 28 is urged against the heat generating member 42 with the interposition of a fixing film 25 to form a fixing nip N between the heat generating member and the pressure roller. Electromagnetic induction heat is generated from the electromagnetic induction heat generating magnetic metal member (heat generating member) 42 by high frequency magnetic field generated by energizing an excitation coil (magnetic field generating means) 43, and the heat is applied to the transfer material (recording material) P introduced into the fixing nip N via the fixing film 25 at the fixing nip N. The fixing film 25 itself may be formed from electromagnetic induction heat generating material.

In the present invention, the fixing apparatus of film fixing type may be the apparatus as mentioned above.

Further, the pressure member (roller) cleaning process may be performed effected when the transfer material is not passed through the fixing apparatus, as well as the pre-rotation or post-rotation of the apparatus.

In addition, the image forming means of the image forming apparatus is not limited to the transfer-electrophotographic process disclosed in the illustrated embodiments, but an electrostatic recording process in which an electrostatic recording dielectric body is used as the image bearing member 10 or a magnetic recording process in which a magnetic recording magnetic body is used as the image bearing member 10 may be used, or, in place of the transfer type, an image forming means of direct type in which a toner image is directly formed on a recording material such as a photosensitive sheet (for example, electrofax sheet or an electrostatic recording sheet) may be used.

While the present invention was explained in connection with embodiments thereof, the present invention is not limited to such embodiments, various alteration can be made within the scope of the invention.

What is claimed is:

1. An image forming apparatus comprising:

image forming means for forming a non-fixed toner image on a recording material;

heating means for heating the non-fixed toner image;

a back-up member for cooperating with said heating means to form a nip therebetween, said back-up member pinching and conveying the recording material at said nip in such a manner that the non-fixed toner image is contacted with said heating means so that the non-fixed toner image is fixed to the recording material by heat from said heating means;

a cleaning member for cleaning said back-up member, said cleaning member being brought to a first cleaning mode and a second cleaning mode in both of which an image forming operation is not effected and said back-up member is cleaned, said second cleaning mode having a cleaning time longer than a cleaning time of said first cleaning mode; and a controller for controlling the cleaning member in the first cleaning mode and the second cleaning mode.

2. An image forming apparatus according to claim 1, wherein said second cleaning mode is performed every predetermined interval of a fixing operation.

3. An image forming apparatus according to claim 2, wherein said predetermined interval corresponds to the predetermined number of the recording materials.

4. An image forming apparatus according to claim 1, wherein said back-up member is a pressure roller and said cleaning member is a cleaning roller, and said pressure roller and said cleaning roller are rotated while being contacted with each other in said first and second cleaning modes.

5. An image forming apparatus according to claim 4, wherein said pressure roller and said cleaning roller are rotated for a predetermined time in said second cleaning mode.

6. An image forming apparatus according to claim 1, wherein a temperature of said cleaning member is maintained not less than a glass transition temperature of toner and not more than a softening temperature of the toner during at least a part of said second cleaning mode.

7. An image forming apparatus according to claim 1, wherein said second cleaning mode is effected immediately after a fixing operation is finished.

8. An image forming apparatus according to claim 1, wherein said sec o nd cleaning mode is effected immediately before a fixing operation is started.

9. An image forming apparatus according to claim 1, wherein said heating means includes a heater, and said heater is controlled to reach a predetermined temperature in said second cleaning mode.

10. An image forming apparatus according to claim 9, wherein, in said second cleaning mode, after said heater is controlled to a first temperature, said heater is controlled to a second temperature lower than said first temperature.

11. An image forming apparatus according to claim 1, wherein said cleaning member is heated by heat from said heating means through said back-up member.

12. An image forming apparatus according to claim 1, further comprising a heater for heating said cleaning member directly.

13. An image forming apparatus according to claim 1, wherein said heating means includes a heater and a film one surface of which is shifted together with the recording material while the other surface of which is sliding on said heater, the non-fixed toner image is heated by heat from said heater via said film.

14. A fixing apparatus comprising:

a heater;

a film having one surface slidable on said heater and an other surface contactable with a recording material bearing a non-fixed toner image while shifting together with the recording material;

a back-up member for cooperating with said heater to form a nip therebetween via said film, said back-up member pinching and conveying the recording material at said nip in such a manner that the non-fixed toner image is contacted with said film so that the non-fixed toner image is fixed to the recording material by heat from said heater via said film;

a cleaning member for cleaning said back-up member, said cleaning member being heated only by heat of said heater; and control means for controlling in such a manner that said cleaning member has a temperature maintained not less than a glass transition temperature of toner and not more than a softening temperature of the toner during at least a part of a cleaning operation.

15. A fixing apparatus according to claim 14, wherein said fixing apparatus can be applied to an image forming apparatus having an image forming means for forming a non-fixed toner image on a recording material, and said heater is energized and heated in response to initiation of an image forming operation.

16. A fixing apparatus according to claim 14, wherein said back-up member comprises a pressure roller and said cleaning member comprises a cleaning roller, and said pressure roller and said cleaning roller are rotated while being contacted with each other during the cleaning operation.

17. A fixing apparatus according to claim 16, wherein said pressure roller and said cleaning roller are rotated for a predetermined time during said cleaning operation.

18. A fixing apparatus according to claim 14, wherein the cleaning by means of said cleaning member is effected immediately after a fixing operation is finished.

19. A fixing apparatus according to claim 14, wherein the cleaning by means of said cleaning member is effected immediately before a fixing operation is started.

20. A fixing apparatus according to claim 14, wherein said heater is controlled to reach a predetermined temperature in the cleaning operation effected by said cleaning member.

21. A fixing apparatus according to claim 20, wherein, in the cleaning operation effected by said cleaning member, after said heater is controlled to a first temperature, said heater is controlled to a second temperature lower than said first temperature.

22. A fixing apparatus according to claim 14, wherein said cleaning member is heated by heat from said heater through said film and said back-up member.

23. A fixing apparatus according to claim 14, wherein the cleaning operation by means of said cleaning member is performed every predetermined interval of a fixing operation.

24. A fixing apparatus according to claim 23, wherein said predetermined interval corresponds to the predetermined number of the recording materials.

25. A fixing apparatus according to claim 14, wherein said fixing apparatus can be applied to an image forming apparatus having an image forming means for forming a non-fixed toner image on a recording material, and the cleaning operation by means of said cleaning member is performed while an image forming operation is not being performed.

* * * * *

UNITED STATES PATENT AND TRADEMARK OFFICE

CERTIFICATE OF CORRECTION

PATENT NO. : 6,026,272

DATED : February 15, 2000

INVENTOR(S): KENSAKU KUSAKA, ET AL.

It is certified that error appears in the above-identified patent and that said Letters Patent is hereby corrected as shown below:

COLUMN 1:
Line 25, "photosensitive," should read --photosensitive member,--.

COLUMN 4:
Line 47, "a abut" should read --an abut--.

COLUMN 5:
Line 3, "can" should read --can be--.

COLUMN 6:
Line 54, "suppressing" should read --suppress--.

COLUMN 10:
Line 38, "is remained on" should read --remains on--.

COLUMN 12:
Line 48, "is" should be deleted;
Line 49, "remained" should read --remains--;
Line 63, "remained" should read --remaining--; and
Line 67, "rear" should read --the rear--.

UNITED STATES PATENT AND TRADEMARK OFFICE

CERTIFICATE OF CORRECTION

PATENT NO. : 6,026,272

DATED : February 15, 2000

INVENTOR(S): KENSAKU KUSAKA, ET AL.

It is certified that error appears in the above-identified patent and that said Letters Patent is hereby corrected as shown below:

COLUMN 15:
Line 24, "processes" should read --process--.

COLUMN 17:
Line 11, "by" should read --by a--.

COLUMN 18:
Line 18, "sec o n
d" should read --second--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*